US005207393A

United States Patent [19]

Marscholl

[11] Patent Number: 5,207,393

[45] Date of Patent: May 4, 1993

[54] ELECTRIC-MOTOR DRIVE FOR A BOWDEN-CABLE WINDOW LIFTER

[76] Inventor: Klaus Marscholl, Kreisstrasse 5, D-6332 Ehringshausen-Breitenbach, Fed. Rep. of Germany

[21] Appl. No.: 747,328

[22] Filed: Aug. 19, 1991

[30] Foreign Application Priority Data

Aug. 30, 1990 [DE] Fed. Rep. of Germany ..... 4027444

[51] Int. Cl.[5] ..... B65H 75/38; E05F 15/16; E05F 11/48

[52] U.S. Cl. ..... 242/54 R; 49/349; 49/352

[58] Field of Search ..... 242/54 R; 49/349, 352, 49/353; 74/501.5 R, 505, 506

[56] References Cited

U.S. PATENT DOCUMENTS 3,203,690 8/1965 Werner ..... 49/349
3,876,184 4/1975 Eudy ..... 242/54 R X
4,821,589 4/1989 Fukumoto et al. ..... 49/349 X

*Primary Examiner*—John M. Jillions

*Attorney, Agent, or Firm*—Longacre & White

[57] ABSTRACT

The invention concerns an electric-motor drive system for a bowden-cable window lifter. The system includes a braking spring in the form of a helical spring in the manner known from manual bowden cable window lifters. This is made possible by the inclusion on the worm wheel of an arcuate slot crossed by a tab affixed to the cable reel and extending to the other side of the worm wheel into the clearance of a ring affixed to the worm wheel. The ring and the tab are enclosed by the helical spring of which the bent-off ends each enter the gap between the tab and ring. These components (ring, tab, and spring) are combined to one side of the worm wheel, and achieve the locking of the cable mechanism—by expanding the spring against a surrounding braking surface—when the mechanism is actuated in reverse by movement of the window pane. Owing to this braking mechanism it becomes possible to select the pitch of the worm and worm-wheel at the most advantageous angle irrespective of the otherwise required self-locking between the worm and worm wheel ordinarily used to stop undesired pane movement.

5 Claims, 1 Drawing Sheet

ELECTRIC-MOTOR DRIVE FOR A BOWDEN-CABLE WINDOW LIFTER

BACKGROUND OF THE INVENTION a. Field of the Invention

The invention concerns an electric-motor drive for a bowden-cable window lifter. More particularly the invention is directed to an electric-motor drive for a bowden-cable window lift including a brake for stopping unintended or forced reverse actuation of the window lift by manually urging the window pane into an open position.

b. Description of the Prior Art

It is known as regards window lifters for automobiles and similar vehicles that a stop or other braking system must be provided in the mechanism chain between the drive and the window pane to be moved. Such a brake prevents the window pane from being moved down by applying force on the pane itself.

As regards manually powered bowden-cable window lifters, a helical spring acting as a braking spring is provided for that purpose, which in its function as a wrapping spring encloses both the crank bolt and a fork affixed to the cable reel and of which the bent-off ends are displaced by the crank pin when the latter is actuated. In this known construction, manual actuation in one direction contracts the spring, however, upon actuation of the cable reel itself through the pane in an opposing direction the spring undergoes spreading (expansion) and presses itself against the wall of a surrounding braking cup.

Heretofore such a braking spring has been omitted in bowden-cable window lifters driven by electric motors. The mechanism chain of such a conventional bowden cable drive passes from the electric motor through a worm affixed to the motor shaft to a worm wheel coupled to a cable reel for joint rotation. As a result, the force transmission—and hence also the worm motion at the engaging site on the worm wheel—is blocked nearly automatically if the mechanism chain is actuated in reverse through the window pane because as a rule the worm wheel cannot fully rotate a worm. However, this self-locking depends on the pitch angle and the flank shapes of the worm wheel toothing and the level of wear experienced by the engaging portions of the worm and worm wheel. If the engaging angle between the worm and worm wheel is relatively shallow, and if the tooth or thread flanks are sufficiently smooth, then self-locking no longer takes place, and the worm can indeed be rotated easily by the worm wheel.

Such a relatively shallow angle however is desirable for drive means of the kind described herein because only with such shallow angles is it possible to translate the window pane by comparatively few motor revolutions to close, lower or open the window. If the worm pitch were steeper, and with a matching worm wheel, substantially more motor revolutions would required to open or close the window and accordingly a substantially longer time would be required.

As a result of the desired driving speed relationship in known worm gear/worm wheel mechanisms, the self-locking ordinarily provided by the worm and the worm wheel no longer is present. Therefore it is the object of the invention to create a drive of the stated kind which is capable of stopping displacement of the pane in spite of a shallow worm pitch if the attempt is made to move the mechanism chain by means of the window pane.

SUMMARY OF THE INVENTION

The essential concept of the invention is to provide a slot in the shape of an arc or circle in the worm wheel and to also use a tab projecting from the cable reel oriented so as to pass through this slot. A ring, or a sleeve or the like is present with the same circumference on the worm wheel and comprises a clearance at one site of its circumference, said clearance being entered by the tab affixed to the cable reel. These components are enclosed by a helical spring acting as a braking spring in the manner known for manual window lifters.

This braking spring also operates in the same manner as in the manual window lifters: if the mechanism is set into motion by the motor and by the worm and worm wheel, then the spring is contracted by the bent ends and releases the mechanism. If on the other hand the mechanism is set in motion by the cable reel, for instance by an attempt to force or jar the window pane up or down, then the braking spring spreads apart and rests against the inside wall of the braking pot and locks the mechanism.

The invention is shown by an illustrative embodiment of the drawing.

DETAILED DESCRIPTION OF THE INVENTION

Figure 1:
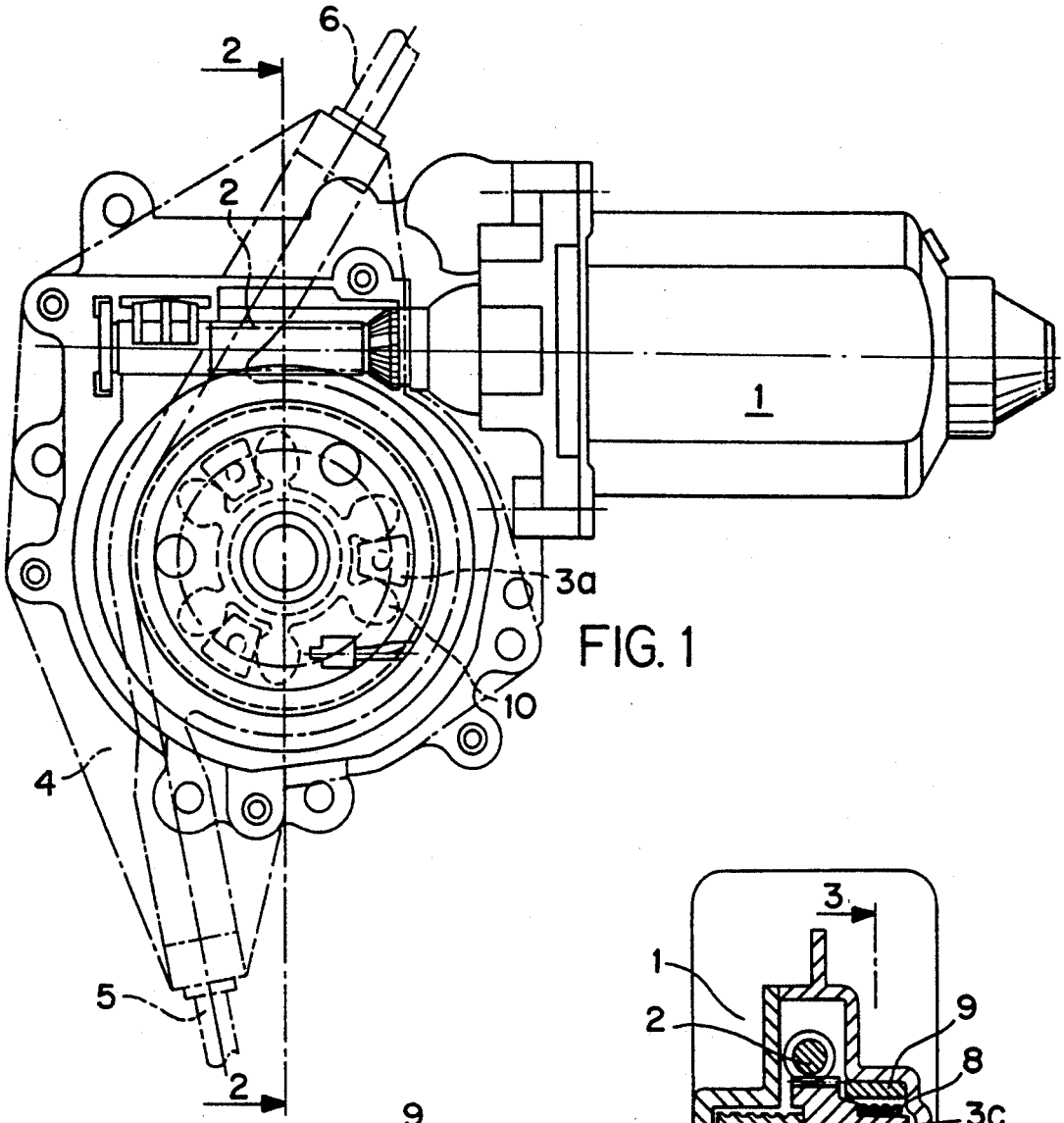
FIG. 1 is a partial cut away plan view of the drive.
Figure 3:
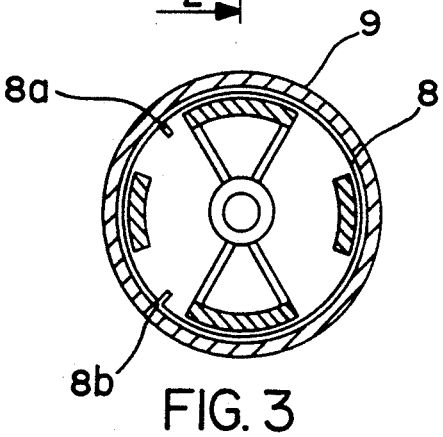
FIG. 3 is a sectional view of the drive shown in FIG. 1 along line III—III shown in FIG. 2.

FIG. 1 shows a motor 1 which by means of a worm 2 drives a worm wheel 3. The worm wheel 3 rests inside a housing 4 to which are hooked-up the tubes 5 and 6 of the bowden-cable window lifter.

Figure 2:
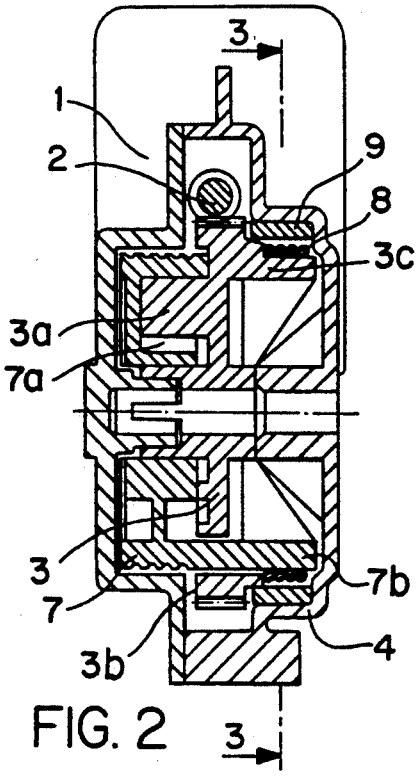
FIG. 2 is a sectional view of the drive shown in FIG. 1 along the line II—II.

In FIG. 2, the housing lid is omitted for the sake of clarity.

The worm wheel 3 is coupled by at least one projecting tab **3*a* to a cable reel 7 and for that purpose enters a recess 7*a* of the cable reel 7. As a result, upon rotation of the motor 1 and actuation of the worm gear 2, the cable reel then is made to rotate through the action of worm 2 and worm wheel 3**.

The drive mechanism also includes a damping element 10 incorporated into the drive between the worm wheel 3 and the cable reel 7. The damper element 10 may be made of rubber or other shock absorbing material and is intended to damp the driving shocks between the worm wheel and cable reel when the driving motor 1 is activated to drive the pane and deactivated to stop the pane.

The worm wheel 3 includes two arcuate slots **3*b* through which are crossed by two tabs 7*b* affixed to the cable reel 7. The slots 3*b* are somewhat wider in the circumferential direction of the worm wheel than are the tabs 7*b***.

The worm wheel 3 also includes two projecting rings **3*c* on the circumference of the wheel 3. The rings 3*c* includes a clearance at least in the sector of the slots 3*b*, so that the tabs 7*b* affixed to the cable reel 7 entering between the flanks of the slots 3*b*** are unimpaired.

The rings **3*c* and the tabs 7*b* are enclosed by a helical spring 8 of which the ends 8*a* and 8*b*** are bent off and each enter the circumferential gaps remaining between the rings 3c and the tabs 7b. In turn the spring 8 is tightly enclosed by a steel ring 9 rigidly joined to the housing 4.

The components, and in particular the helical spring 8, operate in the manner known from manual window lifters. If the drive mechanism chain is set in motion by the motor, then the worm 2 rotates the worm wheel 3 and thereby also rotates the rings 3c affixed to latter. Depending on the direction of rotation, the rings 3c hit by one edge of their clearance either the bent-off spring end 8a or 8b. In either case the spring 8 is made to contract thereby so that the tabs 3a drive the cable reel 3, and the cable with the window pane (not shown) suspended from it is displaced in either direction.

If on the other hand, the attempt is made to set the mechanism chain in motion illustratively by depressing or tugging on a half open window pane, then the cable reel 7 is rotated, and thereby its affixed tabs 7b now impact the bent-off spring end 8a or 8b. As a result the spring 8 virtually bends outwardly by the force of the tab 7b and is jammed against the inside of the steel ring 9. The drive system now is locked. Therefore it is impossible to force the window pane either up or down.

In order that the operations occur as described above, the worm wheel 3 and the cable reel 7 must be connected with such play that first the tabs 7b affixed to the drive side shall impact a spring end before the output link (cable reel 7 or worm wheel 3) is displaced.

This type operation and the necessary clearances and space relationships is known in all respects and fully corresponds to the operation of a manually driven bowden type window lifter.

The invention is the result of a combination of certain known features of a manual bowden window winder into a motor drive in such a way that the worm wheel comprises two slots 3b through which pass the tabs 7b affixed to the cable reel 7 whereby, on the other side of the wheel worm 3, the tabs 7b affixed to the wheel worm 3 and to the cable reel 7 can be made to operationally engage the helical spring 8 (also called wrapping spring or braking spring) and bind movement of the window winder mechanism.

Alternatively to the shown arrangement of cooperating slot and tab, the respective operational association of the tab to the reel and the slot to the wheel may be reversed. Illustratively the cable reel can be provided with an arcuate slot crossed by a tab affixed to the worm wheel. While the inventive conception is the same, construction costs may be substantially higher.

In the described embodiment, the rings 3c furthermore may be so minimized that only their two end pieces at the clearance would remain. In such a configuration there would be two tabs rigidly joined to the worm wheel and cooperating with the spring ends 8a, 8b; material and weight is saved thereby. No change in operation is incurred.

As already explained, the otherwise known locking of the worm/worm wheel drive system against being forcibly driven by the window pane at the engagement site of worm and worm wheel is made superfluous by this invention. Accordingly the most advantageous pitch angle may be selected for the worm and worm wheel irrespective of any otherwise required self-locking.

What is claimed is:

1. A drive system, powered by an electric motor, for a bowden-cable window pane lifter comprising:

a housing;

an electric motor mounted on said housing and driving a worm gear;

a cable reel mounted for rotation in said housing about an axis, and including a first tab element extending therefrom;

a worm wheel also mounted for rotation in said housing about said axis adjacent to said cable reel and driven by the motor through said worm gear, said worm wheel comprising on a side of said worm wheel facing said cable reel at least one axially projecting element entering a complementary recess in an opposite surface of said cable reel and driving the latter into rotation, said worm wheel also including a second tab element projecting therefrom;

a helical spring serving as a braking spring for said worm wheel, said spring being wrapped circumferentially in said housing in the region of said worm wheel and cable reel, said spring including two end portions each bent so as to engage either of said first or second tab elements; wherein, when said worm gear drives said worm wheel, said second tab element engages an end portion of said spring and causes said spring to rotate along with said worm wheel, and when said cable reel is rotated, said first tab element engages an end portion of said spring and causes said spring to contact said housing and brake rotation of said worm wheel.

2. A drive as in claim 1, wherein:

said first tab affixed to said cable reel projects along said axis and passes through a slot in the worm wheel 3, and said second tab affixed to the worm wheel projects in the same direction as said first tab, said helical spring circumferentially surrounding said tabs such that said helical spring is spread apart and pressed against an inside wall of said housing when said cable reel is driven by movement of a window pane.

3. A drive as in claim 2, wherein:

said helical spring is surrounded by a braking surface which stops expansion of said spring to brake rotation of said cable reel.

4. A drive as in claim 3, wherein:

said braking surface is integrated as an annular recess into said housing.

5. A drive as in claim 4, wherein:

said housing is comprised of a lightweight element and said annular recess is lined by a steel ring against which the braking spring will spread.

* * * * *